US006926181B1

(12) United States Patent
Vath

(10) Patent No.: US 6,926,181 B1
(45) Date of Patent: Aug. 9, 2005

(54) CHILD CARRIER TRANSPORT SYSTEM

(76) Inventor: Jennifer Vath, 20702 Cricket La., Lenexa, KS (US) 66220

( * ) Notice: Subject to any disclaimer, the term of this patent is extended or adjusted under 35 U.S.C. 154(b) by 128 days.

(21) Appl. No.: 10/364,696

(22) Filed: Feb. 11, 2003

(51) Int. Cl.[7] ..... A47C 5/00; A61G 1/00; A61G 5/00

(52) U.S. Cl. ..... 224/159; 224/258; 224/660

(58) Field of Search ..... 224/158–160, 224/258, 660, 662, 663, 665, 671, 674, 675; 297/183.1, 183.6, 250.1

(56) References Cited

U.S. PATENT DOCUMENTS 4,366,587 A * 1/1983 Takada ..... 5/94
4,901,898 A * 2/1990 Colombo et al. ..... 224/159
4,993,612 A * 2/1991 Quimby et al. ..... 224/160
5,224,637 A * 7/1993 Colombo ..... 224/159
5,267,680 A * 12/1993 Torok ..... 224/158
5,385,281 A * 1/1995 Byrd ..... 224/148.6
5,492,256 A * 2/1996 Ive ..... 224/159
5,540,365 A * 7/1996 LaMair ..... 224/158
5,775,770 A * 7/1998 Tunney ..... 297/183.1
6,237,999 B1 * 5/2001 Hobson ..... 297/256.15
6,378,746 B1 4/2002 Miller ..... 224/258
6,378,937 B1 * 4/2002 Faudman ..... 297/183.1
6,626,489 B2 * 9/2003 Geis et al. ..... 297/183.1

FOREIGN PATENT DOCUMENTS

EP 0574848 A2 * 12/1993
JP 2000296034 A * 10/2000 ..... A47D 13/02
WO WO94/05189 * 3/1994
WO WO01/12121 A1 * 2/2001

* cited by examiner

*Primary Examiner*—Sue A. Weaver
(74) *Attorney, Agent, or Firm*—Brett Trout

(57) ABSTRACT

A child carrier transport system. The system has a belt releasably secured around a child carrier, and a belt releasably secured around the waist of a user. The belts are coupled to one another and coupled around the base of the handles provided on the child carrier. A pad is secured to the belts to buttress the transmission of potential injurious force between the child carrier and the user. The resulting system is low cost, strong, lightweight, and does not prohibitively restrict movement of the user.

14 Claims, 5 Drawing Sheets

CHILD CARRIER TRANSPORT SYSTEM

BACKGROUND OF THE INVENTION

1. Field of the Invention

The present invention relates to a child seat carrier and, more particularly, to a lightweight, compact child seat transport system, which transfers weight of the carrier and its contents to the waist of a user.

2. Description of the Prior Art

It is well known in the art to provide carriers for children or the like. Such carriers typically include a base or body coupled to a pivotal handle. In many embodiments, the base is specifically designed to attach and detach to an affixed base provided with a vehicle.

One drawback associated with such devices is the orientation of the body of the carrier and the handle pivotally coupled thereto. Prior art designs make it difficult and awkward to hold or transport the carrier by hand, especially for a substantial length of time. It is well known in the art to provide a sling or similar device to transfer the weight of the carrier to the shoulder of a user. Such prior art slings, however, have several drawbacks.

Some of these drawbacks include the carrying location of the body of the carrier being below the knee of the user. With this design the user must force the carrier outward to avoid contact of the carrier with the user's legs while walking. Another drawback associated with such prior art devices is the awkwardness in moving a sling over the user's head and the discomfort and awkwardness of the sling extending across the chest of the user. Extending the sling across the chest of a user could lead to wrinkling, staining or tearing of a shirt or blouse in contact with the sling, and discomfort to the chest area. It would, therefore, be desirable to provide a quick connect system for transferring the weight of a carrier to the body of a user in a manner which secured the carrier near waist level of the user, and which did not substantially interfere with the walking stride of the user. The difficulties encountered in the prior art discussed hereinabove are substantially eliminated by the present invention.

SUMMARY OF THE INVENTION

In an advantage provided by this invention, a child carrier transport system is provided which is of low-cost, lightweight and strong manufacture.

Advantageously, this invention provides a child carrier transport system which quickly connects and disconnects from both a user and child carrier.

Advantageously, this invention provides a child carrier transport system which maintains a child carrier near waist level of a user.

Advantageously, this invention provides a child carrier transport system which reduces contact with and degradation of a shirt or blouse of a user.

Advantageously, this invention provides a child carrier transport system which quickly adjusts to a plurality of various child carriers and a plurality of users of different heights and girths.

In an embodiment of this invention, a system is provided for transporting a child seat having a base, a front, a back, a first side and a second side. The system includes a belt having a first end and a second end, and means for attaching the belt to the base and lateral of the child seat. Means are provided for releasably securing the first end of the belt to the second end in a manner which defines a ring at least fifteen inches in circumference.

Preferably, the attaching means is a second ring provided around the base of the child seat and secured to the handle at the points at which the handle pivotally connects to the base. A pad is also preferably coupled to the belt to buffer pressure of the child seat against the user.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 1:
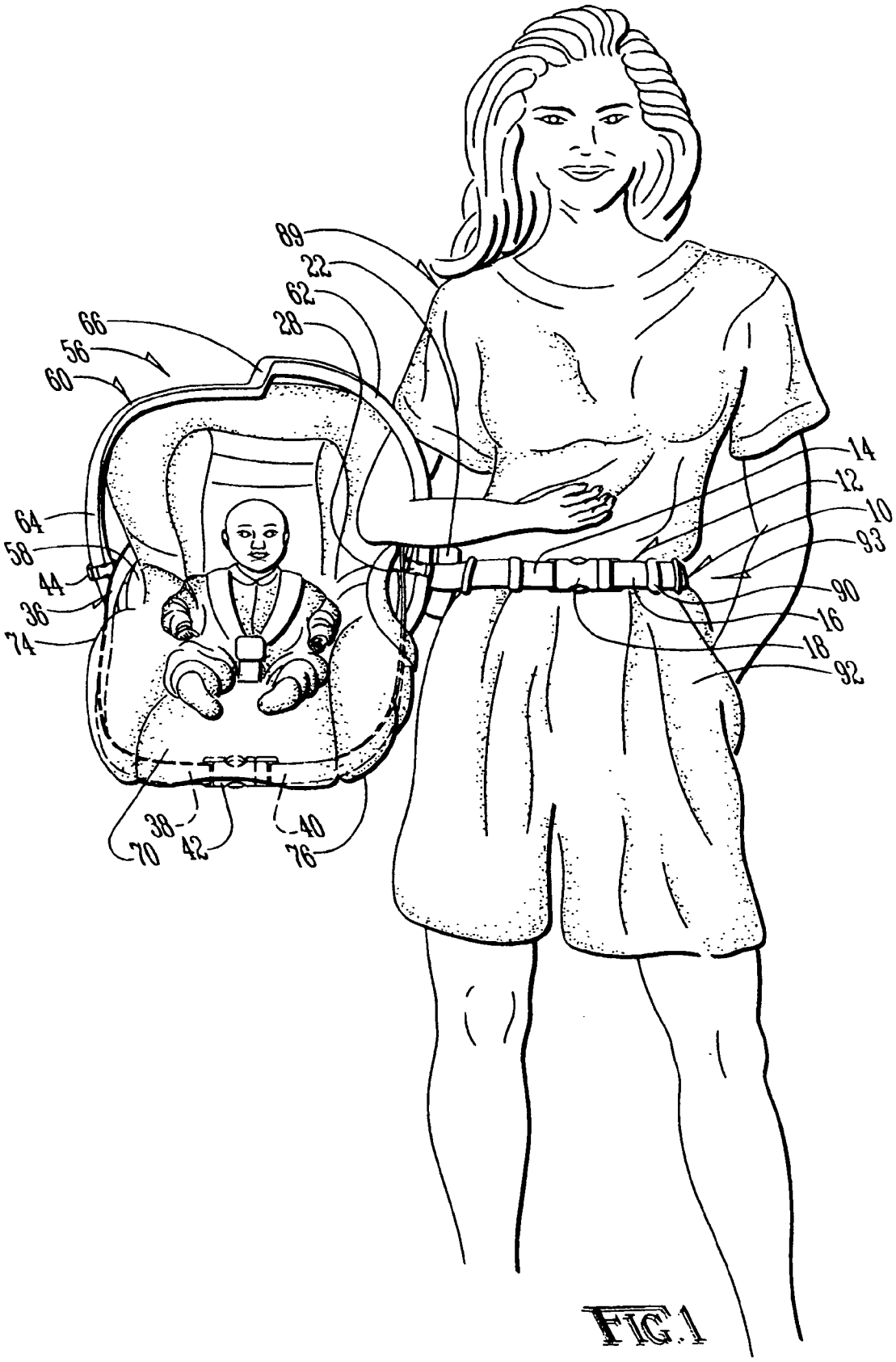
FIG. 1 illustrates a front perspective view of the child carrier transport system of the present invention, shown coupled to a child carrier and a user.
Figure 2:
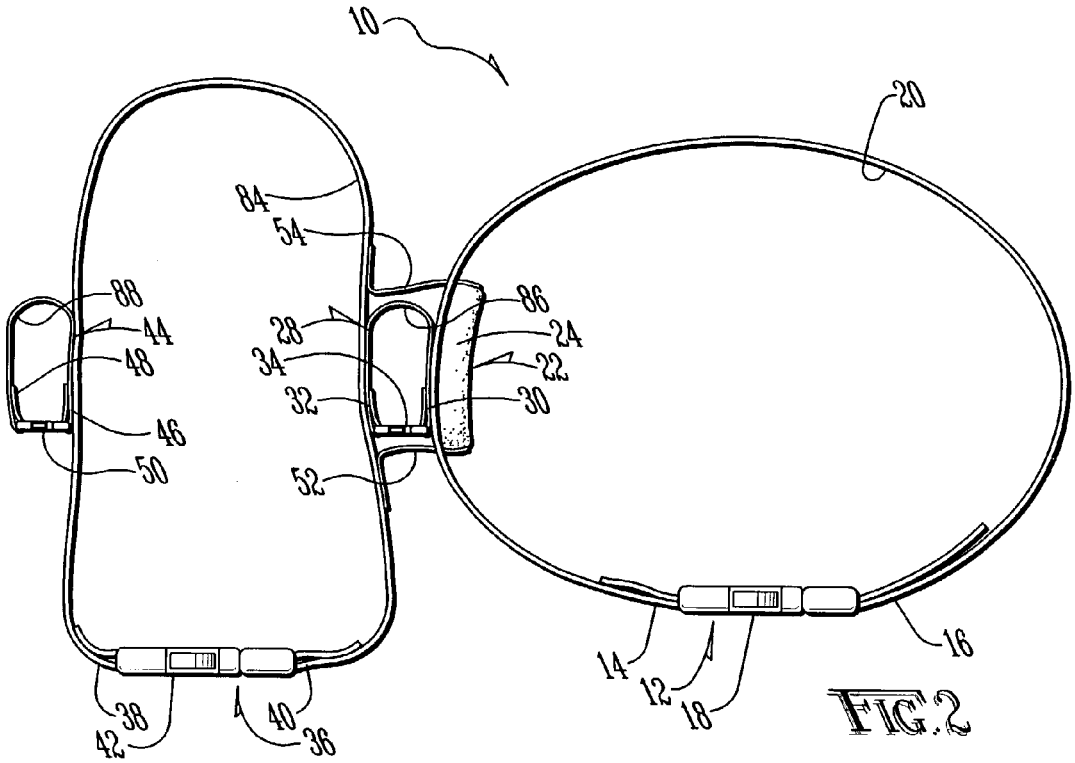
FIG. 2 illustrates a top elevation of the child carrier transport system of FIG. 1.

With reference to the drawings, the child carrier transport system is shown generally as (10) in FIG. 1. As shown in FIG. 2, the child carrier transport system (10) includes a first belt (12). The belt is preferably constructed of two inch wide polypropylene webbing, such as that known in the art. The first belt (12) may, of course, be constructed of any suitably durable material. The first belt (12) preferably includes a first end (14) and a second end (16), coupled to one another by a buckle (18). Although the buckle may be of any type known in the art, in the preferred embodiment, the buckle is of the side release type, such as that generally known in the art to allow for quick adjustment of the side of the interior ring defined by the first belt (12) when the buckle (18) secures the first end (14) to the second end (16).

While the first belt (12) may be of any suitable length, in the preferred embodiment, the first belt (12) is preferably greater than ten inches in length, and less than one hundred inches in length; more preferably greater than twenty inches in length, and less than sixty inches in length; and most preferably, about forty-five inches in length. As noted above, the side release buckle (18) allows for quick adjustment of the side of the circumference (20) of the area defined by the first belt (12) when the buckle (18) is secured. For smaller individuals, the side release buckle (18) may be adjusted as desired and the extraneous lengths of the first belt (12) associated with the first end (14) and second end (16) of the first belt (12) can be tucked around the remainder of the first belt (12), cut off, or otherwise removed from the first belt (12).

Figure 3:
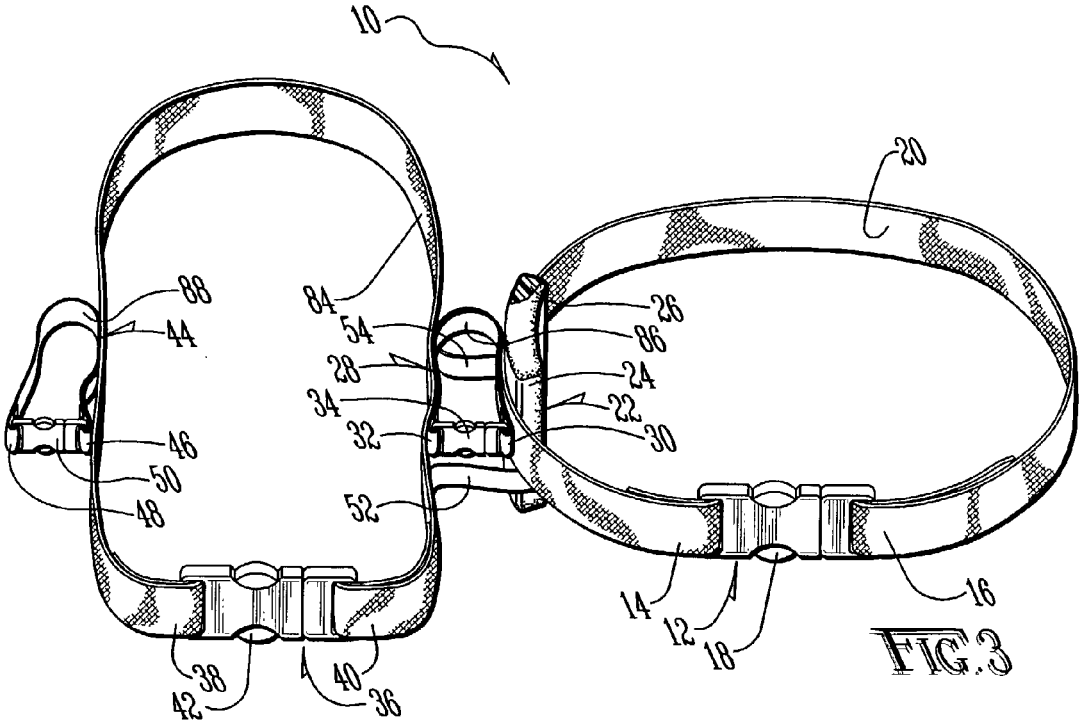
FIG. 3 illustrates a front perspective view in partial cutaway of the child carrier transport system of FIG. 1.

As shown in FIG. 2, secured to the interior circumference (20) of the first belt (12) is a pad (22). The pad (22) is secured to the first belt (12) by stitching, adhesive or any other similar attachment means known in the art. As shown in FIG. 3, the pad (22) is preferably constructed of a tough outer covering (24) constructed of pliable vinyl or the like, and a resilient interior (26) constructed of urethane, silicone rubber, neoprene, thick polypropylene webbing, or any other similar resilient material known in the art. In the preferred embodiment, the pad (22) is a block five inches wide, four inches tall, and two inches thick.

As shown in FIG. 2, also secured to the pad (22) is a first cuff (28). While the first cuff (28) may be constructed of any suitable material, in the preferred embodiment, the first cuff (28) is constructed of one inch thick polypropylene webbing, defining a first end (30) and a second end (32) coupled to one another by a side release buckle (34) such as that described above. While the first cuff (28) may be of any suitable dimensions, in the preferred embodiment, the first cuff (28) is six inches in diameter. The side release buckle (34), however, allows the first cuff (28) to be adjustable as desired.

As shown in FIG. 2, the child carrier transport system (10) also includes a second belt (36). The second belt (36) is preferably constructed of one-inch wide polypropylene webbing, such as that described above. In the preferred embodiment, the second belt (36) is greater than twenty inches in length and less than one hundred inches in length; more preferably, greater than thirty inches in length and less than seventy-five inches in length; and, most preferably, seventy inches in length. The second belt (36) includes a first end (38) and a second end (40), coupled to one another by a side release buckle (42), such as that described above. Secured to the second belt (36) by stitching, adhesive or similar securement means is a second cuff (44). The second cuff (44) includes a first end (46) and a second end (48), secured to one another by a side release buckle (50). The dimensions of the second cuff (44) are similar to those described above in association with the first cuff (28).

As shown in FIG. 2, the second belt (36) is secured to the pad (22) by a first strap (52) and a second strap (54). The straps (52) and (54) are secured to the pad (22) and second belt (36) by stitching, adhesive or similar securement means. The straps (52) and (54) are preferably constructed of one inch wide polypropylene webbing.

Figure 4:
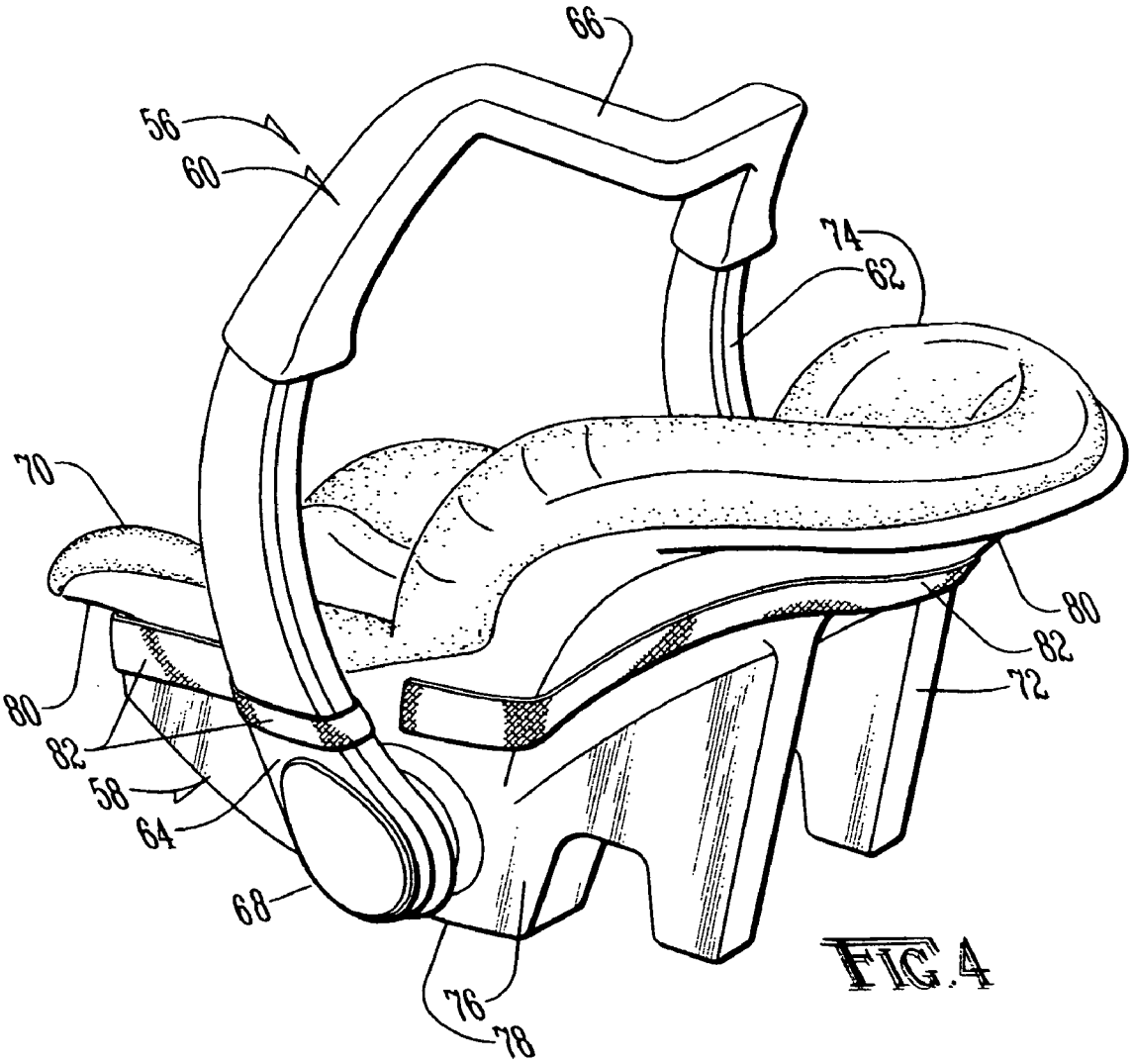
FIG. 4 illustrates a side perspective view of the child carrier, showing the latch and hook material applied to the base and handle of the child carrier.

As shown in FIG. 4, the child carrier (56) includes a base (58) and a handle (60). The handle (60) includes a first arm (62) and a second arm (64), coupled to one another by a grip (66). The first arm (62), second arm (64), and grip (66) are preferably integrally molded of a single piece of thermoplastic material, such as those well known in the art. As shown in FIG. 4, the arms (62) and (64) are pivotally coupled to the base (58) by a pivot assembly (68) such as those well known in the art. The base (58) includes a front (70), a rear (72), a left side (74), a right side (76), a bottom (78) and an overhanging lip (80).

As shown in FIG. 4, when it is desired to utilize the child carrier (56) in accordance with the present invention, strips of hook and latch material (82) are riveted or otherwise secured to the base (58) of the child carrier (56) just under the lip (80). The material (82) is provided around the entire circumference, except for a four-inch section between the arms (62) and (64) and the base (58). The size of the section devoid of material (82) may, of course, be of any suitable dimensions. The material is also provided around each of the arms (62) and (64) immediately above the pivot assemblies (68) and is similarly secured.

Figure 5:
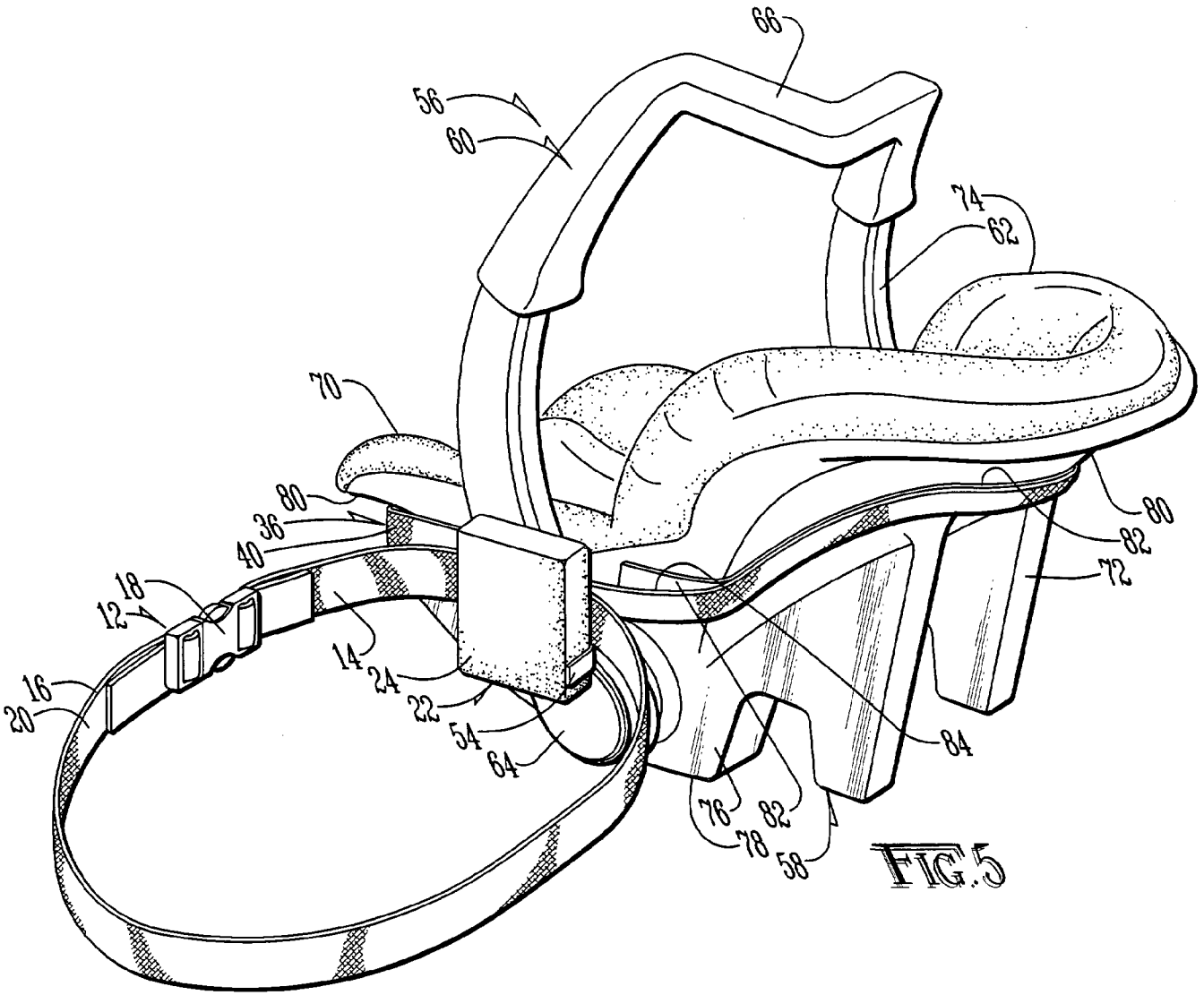
FIG. 5 illustrates a side perspective view of the child carrier, showing the child carrier transport system attached thereto.

As shown in FIGS. 2 and 3, lengths of hook and latch material (84) are provided along the interior circumferences of the second belt (36) and the cuffs (28) and (44). Accordingly, as shown in FIG. 5, the hook and latch material (84) of the second belt (36) secures to the hook and latch material (82) secured to the base (58). The interior circumference defined by the second belt (36) is adjusted to the external circumference of the base (58) using the side release buckle (42), before the buckle (42) is actuated to secure the second belt (36) against inadvertent dislodgement from the child carrier (56).

Similarly, the side release buckle (34) associated with the first cuff (28) is released and the hook and latch material (86), stitched, adhesively secured, or otherwise secured to the interior defined by the first cuff (28), is secured around the first arm (62) of the handle (60), interlocking the hook and latch material (86) of the first cuff (28) with the hook and latch material (82) provided around the first arm (62) of the handle (60), just above the pivot assembly (68). The second cuff (44) is provided with similar hook and latch material (88) and is secured around the second arm (64) of the handle (60) in a similar manner.

Once the second belt (36) and cuffs (28) and (44) have been secured to the child carrier (56), the child carrier (56) is lifted with the handle (60) and the first belt (12) is provided around the user as shown in FIG. 1. The buckle (18) is secured in front of the user retains the first arm (62) as shown in FIG. 1. As shown in FIG. 1, the first belt (12) preferably extends through a plurality of belt loops (90), sewn or otherwise secured to the user's pants (92). The circumference (20) defined by the first belt (12) may, of course, be adjusted by adjusting the buckle (18).

Once the child carrier transport system has been connected as described, the belts (12) and (36), and straps (52) and (54), transfer weight of the child carrier (56) to the user's waist (93). The hook and latch material (82), (84), (86) and cuffs (28) and (44), prevent the child carrier (56) from becoming inadvertently dislodged from the child carrier transport system (10). Additionally, when in use, the pad (22) lies between the user and child carrier (56) to reduce contact of the child carrier (56) with the user and prevent damage or injury associated therewith.

When it is desired to release the child carrier carrying device (10), the first belt (12) is simply unbuckled and removed from the user. If it is desired to completely remove the child carrier transport system (10) from the child carrier (56), the buckles (34), (42), (50) may all be released and the cuffs (28) and (44), and belt (36) are removed from the carrier (56). The buckles (34), (42) and (50) are all positioned facing forward to facilitate access.

Figure 6:
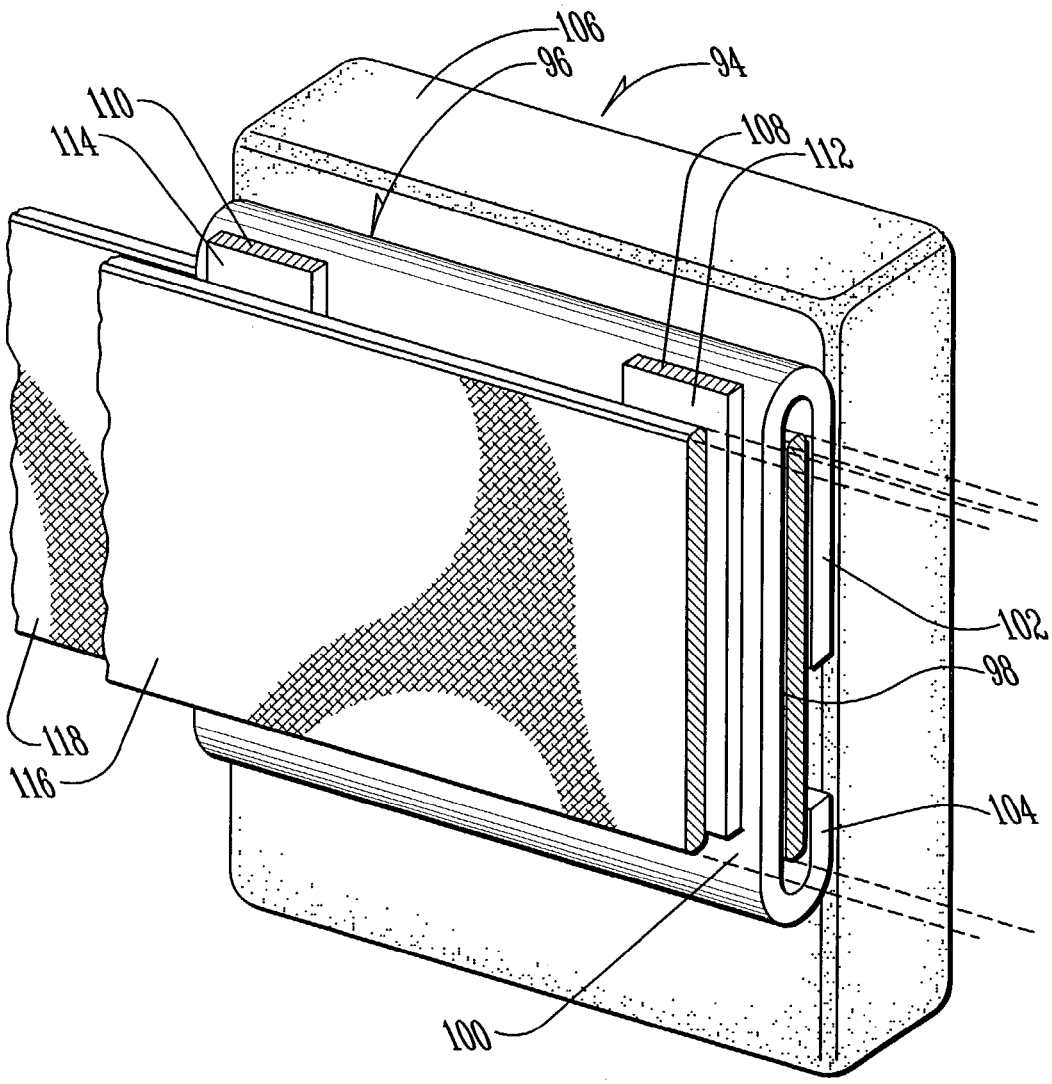
FIG. 6 illustrates a front perspective view in partial cutaway of an alternative embodiment of the present invention utilizing a clip to secure the child carrier to a belt worn by the user.

An alternative embodiment of a connection system is shown generally as (94) in FIG. 6. As shown in FIG. 6, the alternative connection system includes a rigid plastic keeper (96), preferably two inches high and four inches wide, defining an interior (98), ¼ inch side, and 1⅞ inches tall. The keeper (96) may, of course, be constructed of any suitable material and of any suitable dimensions, but in the preferred embodiment is ⅛ inch in thickness. The keeper (96) is preferably provided with a back (100), curving into a long upper catch (102), and a short lower catch (104). The upper catch (102) is preferably at least ½ inch long and, more preferably, over one inch long, while the lower catch (104) is preferably no greater than ½ inch long, and, more preferably, no greater than ¼ inch long.

Adhesively secured or otherwise secured to the upper catch (102) of the keeper (96) is a pad (106), similar to the pad (22) described above. The pad (106) is not secured to the lower catch (104) which allows insertion of a user's belt (118) into the interior (98) of the keeper (96). Adhesively secured or otherwise secured to the back (100) of the keeper (96) are ends (108) and (110) of a pair of straps (112) and (114), similar to the straps (52) and (54) described above. Also secured to the back (100) of the keeper (96) is a second belt (116) similar to the second belt (36) described. In this embodiment, the cuffs (not shown) may be secured on the interior defined by the second belt (116), rather than on the exterior as described above.

When it is desired to utilize the alternative connection system (94), the second belt (116) is secured to the child carrier (56) in a manner such as that described above, and the child carrier (56) is lifted until the alternative connection system (94) is at approximately waist level with the user. The pad (106) is preferably pulled on its lower portion, biasing it away from the lower catch (104) associated with the keeper (96). Once the pad (106) has been pulled away a short distance, the user positions the upper catch (102) around the user's belt (118). Once the belt (118) has been forced fully within the interior (98) of the keeper (96), the lower catch (104) acts to maintain the belt (118) within the interior (98) of the keeper (96), and secure against inadvertent dislodgement. In this embodiment, the pad (106) rests between the user and the keeper (96), absorbing energy and shock from transmitting between the child carrier (56) and user.

Although the invention has been described with respect to a preferred embodiment thereof, it is to be understood that it is not to be so limited, since changes and modifications can be made therein which are within the full, intended scope of this invention as defined by the appended claims.

What is claimed is:

1. A carrier for a child seat having a base, a front, a back, a first side and a second side, the carrier comprising:

(a) a belt comprising a first end and a second end;

(b) means for attaching said belt to the base and lateral of the child seat, wherein said attaching means is a supplemental belt provided around the child seat;

(c) means for releasably securing said first end to said second end in a manner which defines a ring between ten and one-hundred inches in circumference;

(d) means for engaging said supplemental belt with a first arm of a handle of the child seat; and (e) means for engaging said supplemental belt with a second arm of said handle of the child seat.

2. The carrier for a child seat of claim 1 further comprising a cushion secured lateral of the child seat.

3. The carrier for a child seat of claim 2, wherein said belt is secured between said cushion and the child seat.

4. The carrier for a child seat of claim 1, wherein said belt is flexible.

5. The carrier for a child seat of claim 1, wherein said securing means are adjustable securing means for securing said first end to said second end in a plurality of positions defining a plurality of rings of a plurality of circumferential lengths.

6. The carrier for a child seat of claim 1, further comprising a cushion wherein said belt is secured between said cushion and said supplemental belt.

7. A child seat comprising:

(a) a seat comprising a base, a front, a back, a first side and a second side defining a seating area having a length oriented substantially parallel to said first side and said second side, and a width oriented substantially parallel with said front and said back;

(b) means for mounting said first side to a waist of a user, said mounting means comprising:

(i) a first belt;

(ii) first means for coupling said first belt to said first arm;

(iii) second means for coupling said first belt to said second arm;

(iv) a second belt secured to said seat; and (v) means for attaching said first belt to a second belt;

(c) a handle coupled to said seat, said handle comprising:

(i) a first arm coupled to said first side; and (j) a second arm coupled to said second side.

8. The child seat of claim 7, wherein said second belt is provided with a first end and a second end, further comprising means for releasably securing said first end to said second end.

9. The child seat of claim 8, wherein said securing means are adjustable securing means for securing said first end to said second end in a plurality of positions defining a plurality of rings of a plurality of circumferential lengths.

10. The child seat of claim 9, further comprising a cushion coupled to said second belt.

11. A support belt for a child carrier having a body and a handle, the support belt comprising:

(a) a first belt;

(b) means for securing said first belt into an adjustable closed loop opening that captively receives the body of the child carrier;

(c) a second belt;

(d) means for securing said second belt into an adjustable closed loop opening that captively receives a waist of a user;

(e) means for securing said first belt to a first arm of the handle; and (f) means for securing said first belt to a second arm of the handle.

12. The support belt for a child carrier of claim 11, further comprising:

(a) a first piece of hook and latch material secured to said first belt; and (b) a second piece of hook and latch material secured to the body of the child carrier in a manner which receives said first piece of hook and latch material when said first belt is secured to the body of the child carrier.

13. The support belt for a child carrier of claim 11, further comprising padding secured to said second belt.

14. A support belt for a child carrier having a body and a handle, the support belt comprising:

(a) a first belt;

(b) means for securing said first belt into an adjustable closed loop opening that captively receives the body of the child carrier;

(c) a second belt;

(d) means for securing said second belt into an adjustable closed loop opening that captively receives a waist of a user;

(e) means for securing said first belt to a first arm of the handle;

(f) means for securing said first belt to a second arm of the handle; and (g) a third belt secured around a first arm of the handle and a fourth belt secured around a second arm of the handle.

* * * * *